United States Patent [19]

Bachman

[11] Patent Number: 4,703,833

[45] Date of Patent: Nov. 3, 1987

[54] HOLDER FOR STEPLADDER

[76] Inventor: Phil J. Bachman, 2650 Milton Rd., University Hts., Ohio 44118

[21] Appl. No.: 908,606

[22] Filed: Sep. 18, 1986

[51] Int. Cl.[4] ..... E06C 7/14

[52] U.S. Cl. ..... 182/129; 182/222; 248/238

[58] Field of Search ..... 182/124, 125, 129, 28, 182/29, 32, 222, 223; 248/210, 238

[56] References Cited

U.S. PATENT DOCUMENTS 393,591 11/1888 Smith ..... 182/124

2,911,133 11/1959 Ruggieri ..... 182/129

*Primary Examiner*—Reinaldo P. Machado

*Attorney, Agent, or Firm*—Woodling, Krost & Rust

[57] ABSTRACT

A holder or attachment in box like form for use with a stepladder is provided. The box like attachment is provided with a connecting member secured to the bottom of the box with the connecting member being in the form of a tongue. The tongue of the box like member is adapted to reside or fit within the slots formed between support members on a foldable shelf which forms a part of a conventional stepladder and the box is adapted to hold wall papering equipment, cans of paint and tools such as hammers, saws, pliers and screw drivers.

4 Claims, 4 Drawing Figures

HOLDER FOR STEPLADDER

The present invention relates in general to a holder or attachment for use with conventional stepladders that are used around the household and more particularly relates to a holder with a box like shape which has a convenient means for securing the device to a foldable platform conventionally associated with a stepladder. The holder so secured is primarily adapted to contain materials normally used by one around the household. The holder is adapted to carry things such as wall papering equipment, paint cans and tools, such as hammers, saws, screw drivers, and other things that are commonly used by these tools such as nails, screws, bolts and the like.

The prior art abounds with many devices that are designed to be used to hold things on or in association with a conventional stepladder and these devices have met with varying degrees of success.

The difficulties with these prior art devices have usually resulted because the devices cannot be made for a sufficient price that the purchasing public will pay that price to secure one of the devices and an additional difficulty is that the devices are relatively complex in their nature and cannot conveniently be connected and disconnected to the stepladder with which they are to be associated.

The present invention is directed to solving these aforementioned difficulties and has resulted in a holder or attachment for use with a stepladder which is simple and inexpensive in its construction and in its use can be conveniently and quickly connected and disconnected from a stepladder with which it is associated.

Other objects and a fuller understanding of this invention may be had by referring to the following description and claims, taken in conjunction with the accompanying drawings, in which:

DESCRIPTION

FIG. 1 is an isometric fragmentary view of a conventional stepladder as associated with the holder or attachment of the present invention:

FIG. 2 fragmentary enlarged side elevation view of the structure shown in FIG. 1:

Figure 3:
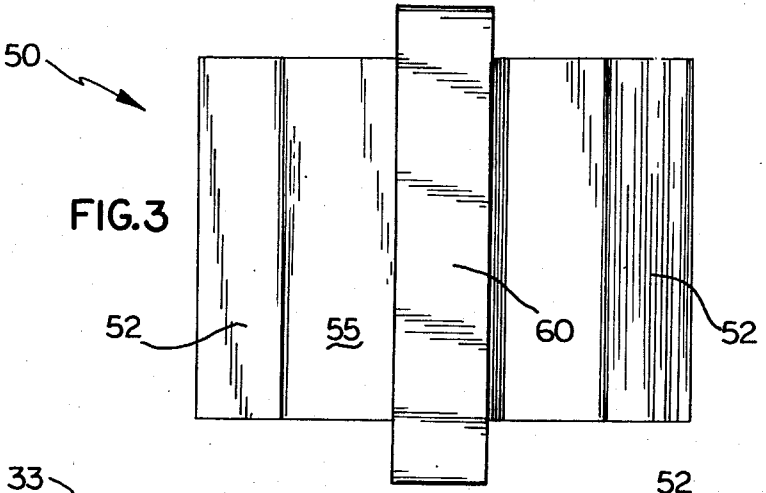
FIG. 3 is a view taken generally along the line 3-3 of FIG. 2.
Figure 1:
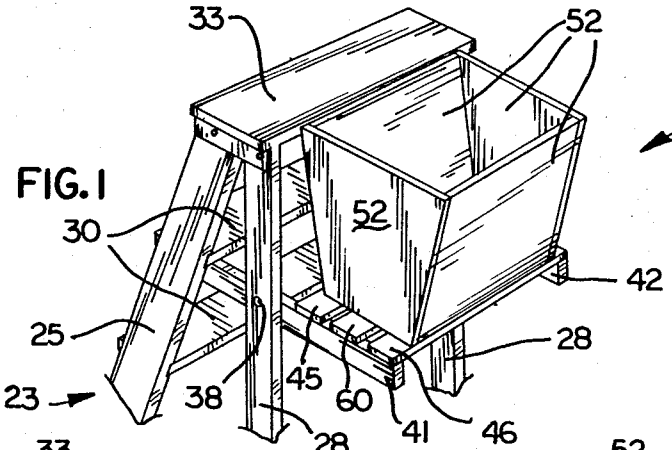
Figure 2:
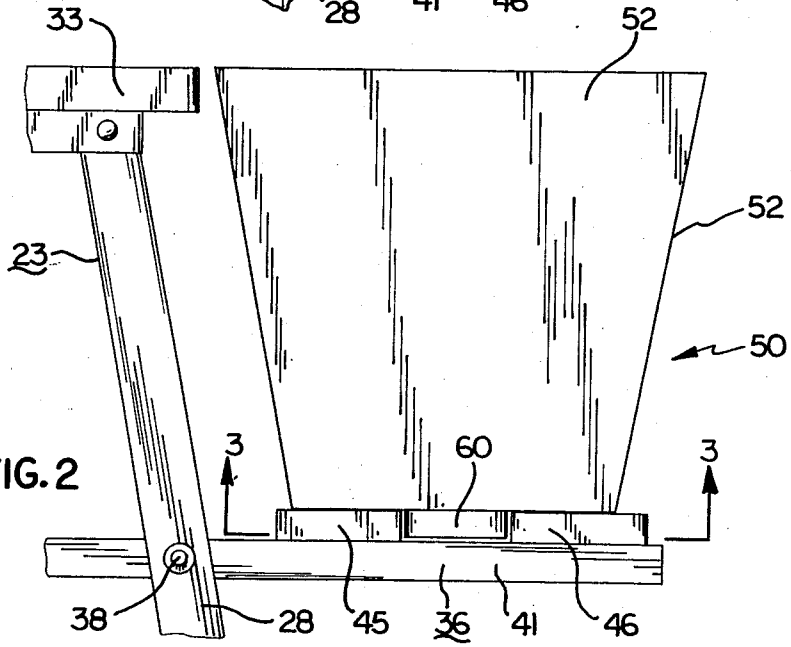

An understanding of the teachings and the structure of the present invention is seen by reference to the drawings and particularly FIGS. 1 through 3. It will be seen that the invention includes the combination of a box like holder or attachment 50 with a stepladder 23. The stepladder includes a frame 25 which supports a plurality of vertically spaced steps all of which have been identified by the reference numeral 30. The steps terminate in an uppermost step which may function as a support platform 33. The stepladder includes legs 28 which are pivotally connected to the support platform in a conventional manner and a foldable shelf 36 is pivoted at opposite sides at 38 to the legs 28. The foldable shelf 36 is pivotable about pivot 38 from the position shown in FIGS. 1 and 2 to a position where the platform is substantially parallel to the legs 28.

The shelf 36 is comprised of first and second spaced and generally parallel support arms 41 and 42 and spaced apart and generally parallel support members extend between the first and second support arms 41,42.

The box like attachment 50 is illustrated for use with the foldable shelf 36 and includes a box like member having vertically extending and connected side walls all identified by the reference numeral 52 with a bottom wall 55 closing the opening formed by the connected side walls 52.

The box like attachment 50 has been illustrated in the specific form shown in the drawings and may be constructed of wood, metal, plastic or other type of construction. The shape of the box like attachment may take practically any form including cylindrical, cubical or trapezoidal and may be provided with or without a handle or finger slots so as to enable ease in handling the attachment 50.

A connecting member 60 is secured to the bottom wall 55 and extends outwardly therefrom and as will be seen in FIG. 2 the connecting member is adapted to reside in the opening or slot formed between support members 45 and 46 of the support platform of the foldable shelf 36. It will be seen that in this position the surfaces of the bottom wall 55 outside the extent of the connecting member 60 engage the top surfaces of support members 45 and 46 to secure the box like attachment in position on the foldable shelf.

Figure 4:
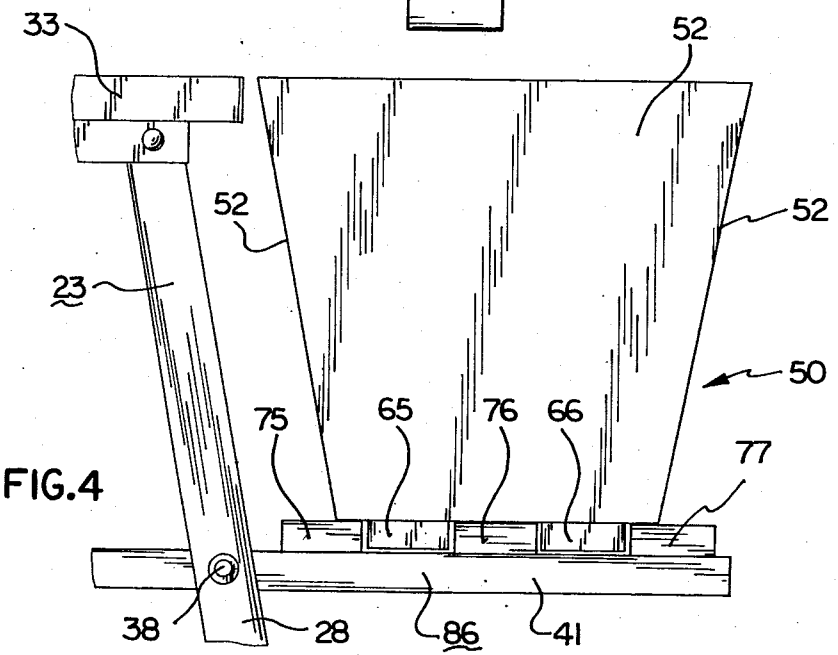
FIG. 4 is a side elevation view similar to FIG. 2 showing a modification of the invention illustrated in FIG. 2.

FIG. 4 illustrates a modification of the invention in that in this embodiment two connecting members 65 and 66 are attached to the bottom wall of the box like attachment and connecting member 65 resides between support members 75 and 76 and connecting member 66 resides between support members 76 and 77. In similar fashion the surface of the bottom wall 55 outside the extent of the connecting members 65 and 66 resides on the upper surfaces of the foldable shelf identified in this figure by the reference number 86 because members 75-77 and slightly differently arranged than members 45, 46 in FIG. 2.

It will thus be seen that there has been illustrated herein a holder for use with the foldable shelf of a stepladder which can be conveniently secured to and disassembled from the foldable shelf without undue manipulation. The box like attachment is adapted to secure or hold many tools utilized by people working around the home and professional workmen. The device is readily adapted to hold cans of paint as well as tools such as hammers, pliers, saws and screw drivers and the various devices that are manipulated by these tools.

The invention has been described in detail with particular emphasis on the preferred embodiments thereof, but it should be understood that variations and modifications within the spirit and scope of the invention may occur to those skilled in the art to which the invention pertains.

What is claimed is:

1. In combination with a stepladder which has a plurality of vertically spaced steps terminating in an uppermost step which may function as a support platform and a foldable shelf pivotal to a position where said shelf is generally parallel to the support platform, said shelf comprising first and second spaced and generally parallel support arms and a plurality of spaced apart and generally parallel support members extending between said first and second support arms, an attachment for use with said foldable shelf including a box like member having vertically extending and connected sidewalls and a bottom wall closing an opening formed by said connected sidewalls, a connecting member secured to said bottom wall and extending outwardly therefrom, said connecting member residing between two of the spaced and generally parallel support members and said bottom wall of said box like member engaging upper surfaces of said support members whereby said box like member is held on said shelf.

2. In the combination as claimed in claim 1 wherein another connecting member is secured to said bottom wall and extends outwardly therefrom and is spaced from and generally parallel to said connecting member, said another connecting member residing between one of said two of said support members and still another of said support members.

3. In combination with a stepladder which has a foldable shelf, said shelf comprising a plurality of spaced apart and generally parallel support member, an attachment for use with said foldable shelf including a box like member having a bottom wall, a connecting member secured to said bottom wall and extending outwardly therefrom, said connecting member residing between two of the spaced and generally parallel support members and said bottom wall of said box like member engaging upper surfaces of said support members whereby said box like member is held on said shelf.

4. In the combination as claimed in claim 3 wherein another connecting member is secured to said bottom wall and extends outwardly therefrom and is spaced from and generally parallel to said connecting member, said another connecting member residing between one of said two of said support members and still another of said support members.

* * * * *